United States Patent [19]

Reichart, Jr.

[11] 3,953,121

[45] Apr. 27, 1976

[54] ARTICULATED DEVELOPMENT APPARATUS

[75] Inventor: Louis W. Reichart, Jr., Rochester, N.Y.

[73] Assignee: Xerox Corporation, Stamford, Conn.

[22] Filed: Oct. 29, 1974

[21] Appl. No.: 518,337

[52] U.S. Cl. ..... 355/3 DD; 118/637

[51] Int. Cl.[2] ..... G03G 15/09

[58] Field of Search ..... 355/3 R, 3 DD, 14; 118/637, DIG. 24; 222/DIG. 1; 96/15 D; 427/18

[56] References Cited

UNITED STATES PATENTS

| | | | |
|---|---|---|---|
| 3,011,474 | 12/1961 | Ulrich | 118/637 |
| 3,628,504 | 12/1971 | Richmond | 118/637 |
| 3,671,119 | 6/1972 | Engel et al. | 355/10 X |
| 3,721,209 | 3/1973 | Szostak et al. | 117/17.5 X |
| 3,854,449 | 12/1974 | Davidson | 355/3 DD |
| 3,880,518 | 4/1975 | Chatfield | 355/16 |

*Primary Examiner*—Robert P. Greiner

*Attorney, Agent, or Firm*—Paul Weinstein; Clarence A. Green; James J. Ralabate

[57] ABSTRACT

A development apparatus and a reproducing machine utilizing the development apparatus is provided for developing images on a moving imaging surface. The apparatus includes at least one developing member. The member extends across the imaging surface to define a gap of a given width. A device is provided for maintaining a substantially uniform gap width which includes an element for supporting the development member for movement both toward and away from the surface from the imaging surface and also for tilting movement with respect to the imaging surface.

17 Claims, 5 Drawing Figures

ARTICULATED DEVELOPMENT APPARATUS

BACKGROUND OF THE INVENTION

This invention relates to a development apparatus and particularly a magnetic brush development apparatus and to an electrostatographic reproducing machine incorporating the development apparatus.

Magnetic brush development has been widely used in a variety of commercially available electrostatographic copying machines. One problem associated with many types of development systems when used to develop an image on a moving imaging surface such as the xerographic drum of a copier is the problem of maintaining alignment between the development system and the xerographic drum. In U.S. Pat. Nos. 3,721,209 to Szostak et al. and 3,671,119 to Engel et al. there are disclosed cascade development systems wherein followers on the housing ride against the drum in order to space the housing from the drum. In U.S. Pat. No. 3,011,474 to Ulrich a xerographic development electrode apparatus is provided wherein the electrode is spaced from a drum-like imaging member by means of followers which ride on the drum surface. In U.S. patent application Ser. No. 255,259, filed May 22, 1972 now U.S. Pat. No. 3,854,449, by Davidson and assigned to the assignee of the instant invention there is disclosed a magnetic brush development system wherein the development roll is spaced from the drum by means of a follower roll which is coupled to the developer housing and rides against the drum. In each of these apparatuses close alignment is maintained with the drum surface by means of followers.

The above-noted approaches, however, do not take into account skew between the imaging surface and the development member and also drum run-out phase variations, which are, for example, variations in the out of roundness of a drum along its axial length. Run-out at one end of a drum can be out of rotational phase with the run-out at the other end.

In U.S. Pat. No. 3,628,504 to Richmond, a mounting apparatus for a development apparatus of an electrostatic copier enables the spacing between the magnetic brush developer and the xerographically sensitive element to be varied across the width of the brush. The apparatus included two independently adjustable eccentric cams which bear upon the developer housing to set the spacing between the housing and the xerographically sensitive element. The spacing is maintained constant independent of dimensional changes in the copier frame units by a spring loaded member bearing on the developer housing. The teachings of this patent describe an approach which could be utilized to overcome skew between a magnetic brush roll and the surface of the imaging member.

SUMMARY OF THE INVENTION

In accordance with this invention a development apparatus is provided for developing images on a moving imaging surface including at least one developing member. The member extends across the surface to define a gap of a given width therebetween. The apparatus includes means for maintaining a substantially uniform gap width across the surface. The maintaining means includes means for supporting the development member the movement toward and away from the surface and also for tilting movement with respect to the surface.

In a preferred embodiment a development roll is supported within a housing and the housing is supported for the movement toward and away from the imaging surface and for tilting movement with respect to the imaging surface. Follower means connected to the housing ride against non-image areas of the imaging surface and biasing means are provided for biasing the housing against the imaging surface to maintain the gap constant.

The apparatus of this invention substantially reduces or eliminates dynamic run-out effects on the development member to imaging surface spacing.

Therefore, it is an object of this invention to provide an improved developing apparatus.

It is a further object of this invention to provide an apparatus as above including means for maintaining the gap between a development member and an imaging surface substantially constant irrespective of skew or run-out phase variations.

It is a further object of this invention to provide an electrostatographic reproducing machine incorporating the above-noted development apparatus.

These and other objects will become more apparent from the following description and drawings.

DETAILED DESCRIPTION OF THE PREFERRED EMBODIMENTS

Figure 1:
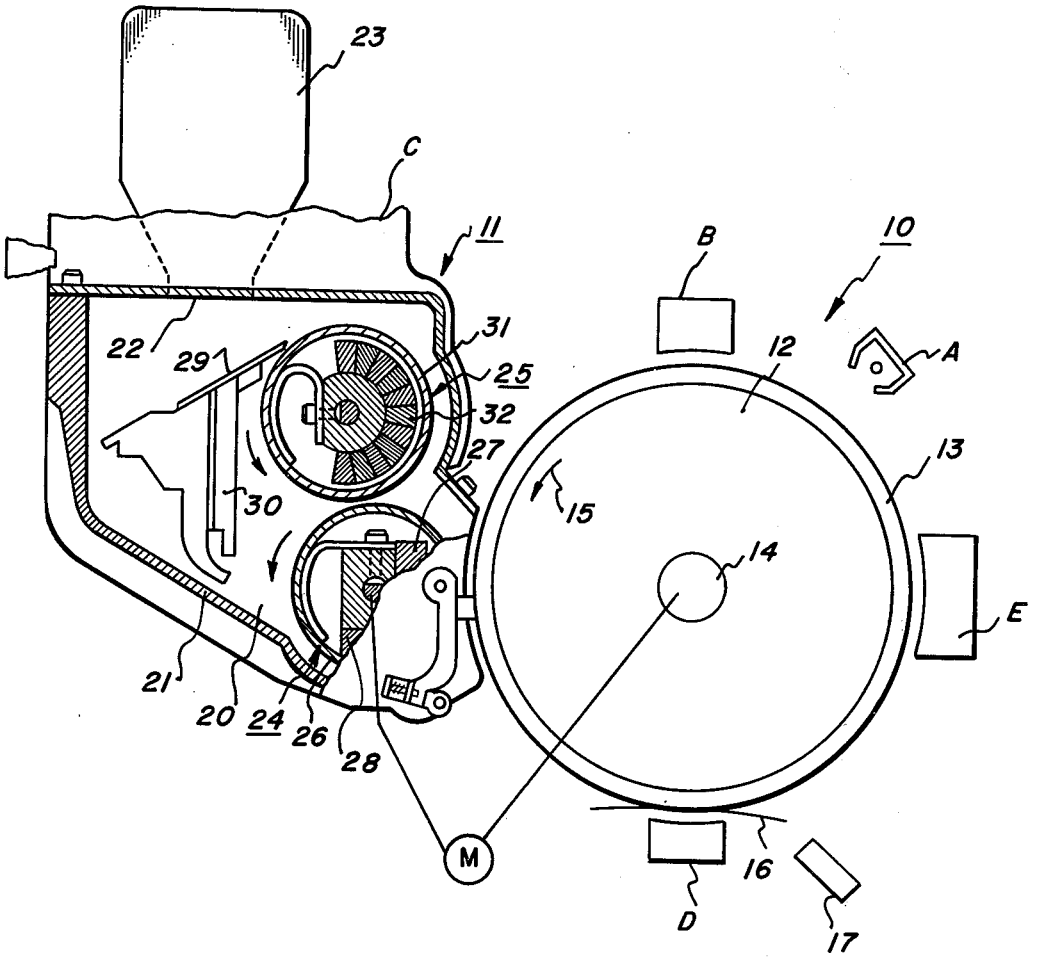
FIG. 1 is a schematic representation of a reproducing machine in accordance with the present invention including the development apparatus of this invention in partial cross-section.
Figure 2:
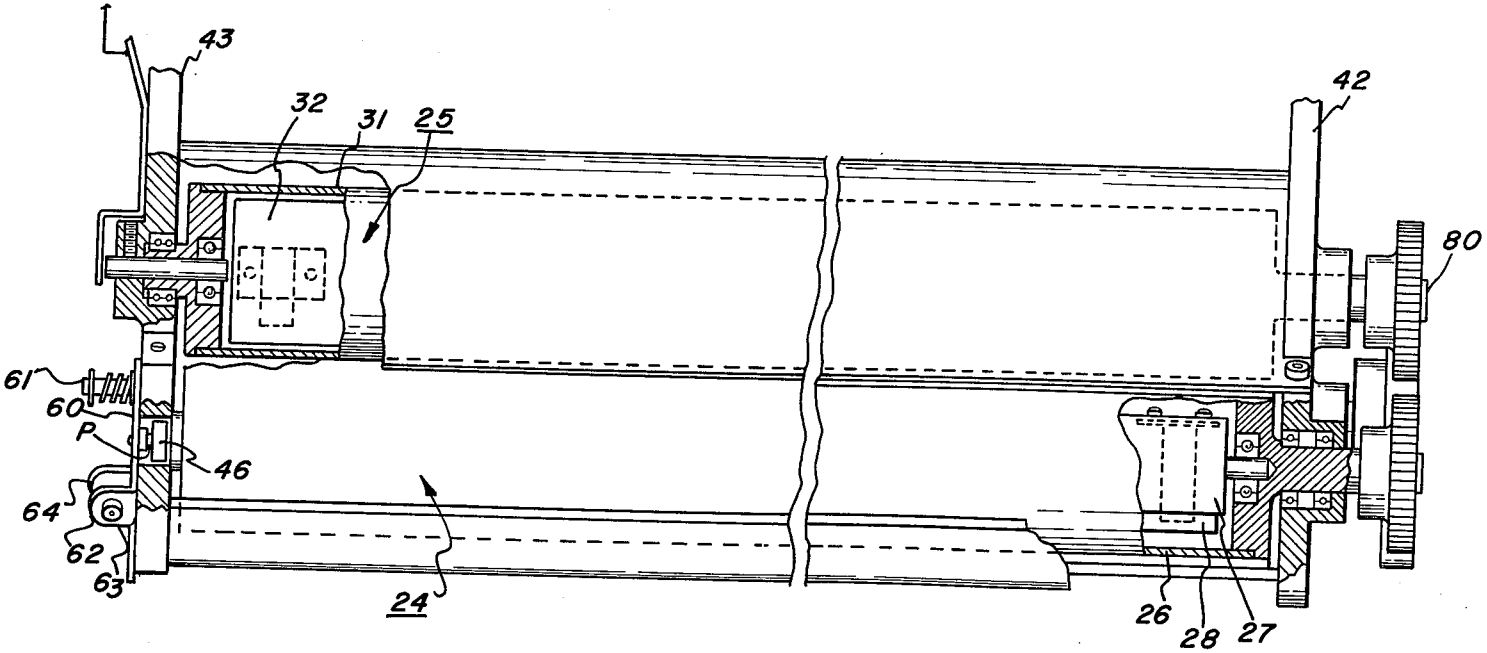
FIG. 2 is a front view in partial cross-section of a development apparatus of this invention.

Referring now to FIG. 2, there is shown by way of example an automatic xerographic reproducing machine 10 which incorporates the magnetic brush development apparatus 11 of the present invention. The reproducing machine 10 depicted in FIG. 1 illustrates the various components utilized therein for producing copies from an original. Although the magnetic brush development apparatus 11 of the present invention is particularly well adapted for use in an automatic xerographic reproducing machine 10, it should become evident from the following description that it is equally well suited for use in a wide variety of processing systems including other electrostatographic systems. It is not necessarily limited in its application to the particular embodiment or embodiments shown herein.

The reproducing machine 10 illustrated in FIG. 2 employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means M are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, published in 1965, and *Xerography and Related Processes* by Dessauer and Clark, published in 1965.

The various processing stations for producing a copy of an original are herein represented in FIG. 2 as blocks A to E. Initially, the drum 12 moves the photoconductive surface 13 through a charging station A. In the charging station A, an electrostatic charge is placed uniformly over the photoconductive surface 13 preparatory to imaging. The charging may be provided by a corona generating device of the type described in U.S. Pat. No. 2,836,725, issued to Vyverberg in 1958.

Thereafter, the drum 12 is rotated to exposure station B wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,832,057, issued to Shogren in 1974. After exposure drum 12 rotates the electrostatic latent image recorded on the photoconductive surface 12 to development station C in accordance with this invention wherein a conventional developer mix is applied to the photoconductive surface 13 of the drum 12 rendering the latent image visible. A suitable development station is disclosed in U.S. Pat. No. 3,707,947, issued to Reichart in 1973. That patent describes a magnetic brush development system utilizing a magnetizable developer mix having ferromagnetic carrier granules and a toner colorant. The developer mix is brought through a directional flux field to form a brush thereof. The electrostatic latent image recorded on the photoconductive surface 13 is developed by bringing the brush of developer mix into contact therewith.

Further details of the development apparatus which comprises development station C will be described later by specific reference to the present invention.

The developed image on the photoconductive surface 13 is then brought into contact with the sheet 16 of final support material within a transfer station D and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 17 which coalesces the transferred powder image thereto. One type of suitable fuser is described in U.S. Pat. No. 2,701,765, issued to Codichini et al. in 1955. After the fusing process the sheet 16 is advanced to a suitable output device.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station E. The toner particles may be mechanically cleaned from the photoconductive surface 13 by any conventional means as, for example, the use of a blade as set forth in U.S. Pat. No. 3,740,789, issued to Ticknor in 1973.

It is believed that the foregoing description is sufficient for purposes of the present application to illustrate the general operation of an automatic xerographic reproducing machine 10 which can include the magnetic brush development apparatus 11 in accordance with the present invention.

Referring now to FIGS. 1–4, the development apparatus 11 includes a storage portion or sump 20 in a housing 21 for storing the developer material. The top of the housing includes an opening 22 with a toner dispenser 23 disposed over it. The toner dispenser periodically dispenses toner into the housing in a manner similar to that taught in U.S. Pat. No. 3,608,792.

The development apparatus 11 includes magnetic brush rolls 24 and 25. The magnetic brush applicator roll 24 includes a rotatably mounted support member in the form of a cylindrical shell or sleeve 26 and a stationary permanent magnet 27 suspended within the sleeve. The magnetic field of the magnet is oriented to form a brush-like structure of the developer mix. The applicator roll 24 is immersed in the sump 20 of developer material which comprises the ferromagnetic carrier particles and a toner colorant. The developer mix is picked up by the outer support surface of the roll 24 by means of a pick-up magnetic field generated by stationary magnet 28 suspended within the sleeve 26, and is formed into a brush-like structure for application to the photoconductive surface 13 for development of the latent electrostatic image presented thereon. While one one applicator roll 24 is shown, any number of applicator rolls could be employed as desired.

Continued rotation of the roll past the development zone brings the magnetic brush into the field of a lifting magnetic brush roll 25. The lifting roll 25 attracts the developer mix from the magnetic brush applicator roll 24 and carries it upward to be deposited on a slide 29 from which it flows into a cross-mixer 30 for return to the sump 20. The lifting roll 25 is also a magnetic brush roll and comprises a non-magnetic cylindrical sleeve 31 rotatably supported in the housing 21 and a fixed permanent magnet 32 supported in a stationary position within the sleeve. It is also possible in accordance with this invention to employ any desired number of lifting rolls 25.

Experience with magnetic brush development systems has shown that the spacing between the imaging surface 13 and the applicator roll 24 is important. The effectivity of the magnetic field is directly dependent on the imaging surface-to-applicator roll spacing. It is common practice to electrically bias the applicator roll 24 to create an electrical field tending to suppress background development. This further increases the sensitivity of the system to any change in the imaging surface-to-applicator roll spacing.

It should be apparent to those skilled in the art that in manufacturing machines of the type above-described, considerable difficulty is encountered in maintaining alignment between the development roll 24 and the imaging surface 13 due to the stack up in the tolerances of the various parts of the apparatus 11. Even though the tolerance for each of the parts of the development apparatus may be quite low, the cumulative tolerance range for the whole apparatus after assembly is raised due to tolerance stack-up. This results in difficulties in manufacturing the machine and in adjusting the development system in the machine 11. Therefore, it has been found that when a development system 11 is mounted in the machine 10 adjacent the imaging surface 13, the development member 24 can be misaligned with respect to the imaging surface. For example, it may be skewed with respect to the imaging surface 13 so that the development member 24 is closer to the imaging surface on one side than on the other. For a magnetic brush development system this will result in uneven densities being printed out on the resulting copy sheet. Skewing between the development member 24 and the imaging surface 13 can result due to misalignment between the development member and the imaging surface and/or due to run-out of the imaging surface.

Run-out may be defined as movement of the imaging surface 13 at the development zone in a direction normal to the imaging surface. For example, if the development member 24 were held in a static position the imaging surface 13 would move toward and away from the development member depending on the degree of run-out. This situation generally arises in the case of imaging surfaces 13 which are moved about an axis of rotation as, for example, a belt or web supported about a pulley or a drum 12 type imaging surface. The run-out occurs due to circumferentially distributed variations in the radius of the outer surface of the pulley or drum.

Drum run-out can be significantly reduced by using extremely precise machining methods. However, this results in a significant manufacturing cost increase and does not represent a viable commerical approach. Therefore, it is necessary, as in accordance with the present invention, to take account of drum run-out in the design of other systems such as the development system 11.

Prior art devices such as those described in the background of this application have principally concerned themselves with compensating for run-out of a circumferential nature alone. It has been found in accordance with this invention that the run-out along the axial length of the curved imaging surface can be out of phase. By this it is meant that run-out at one end of the drum is out of rotational phase with the run-out at the opposing end. For example, if the drum cross-section due to run-out is eliptical then the major axis of the eliptical drum cross-section at one end of the drum would be rotated about the drum axis as compared to the major axis of the eliptical drum cross-section at the opposing end of the drum.

Phase variations in run-out result in a dynamic form of skew between the imaging surface 13 and the development member 24 wherein the skew direction changes as the drum rotates. Therefore, skew can be caused by misalignment between the imaging surface and the development member and also by phase variations in the run-out of the imaging surface.

It has been found in accordance with this invention that prior art solutions to the problem of drum run-out have not accounted for the skewing problem just described, and in particular, skewing due to phase variations in the drum runout.

In accordance with this invention, the development member 24 is supported in a manner which allows it to move both toward and away from the imaging surface 13 and also to tilt with respect to the imaging surface during dynamic operation, namely, during relative movement between the imaging surface and the development member.

In this manner not only are drum run-out variations compensated for, but skew due to drum run-out phase variations and misalignment is also compensated for. This permits closer control of the alignment between the development member 24 and the imaging surface 13 and substantially reduces the impact of tolerance stack-up.

Figure 3:
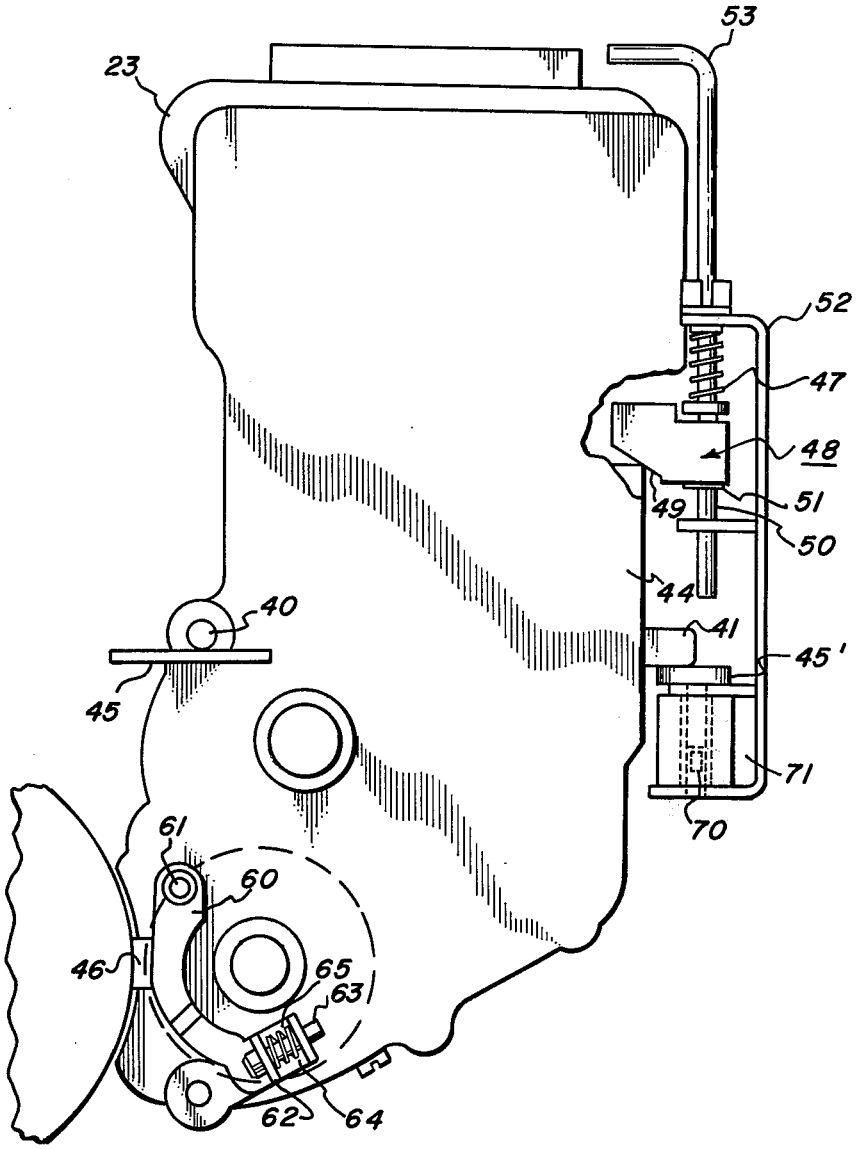
FIG. 3 is a side view of a development apparatus in accordance with this invention.
Figure 4:
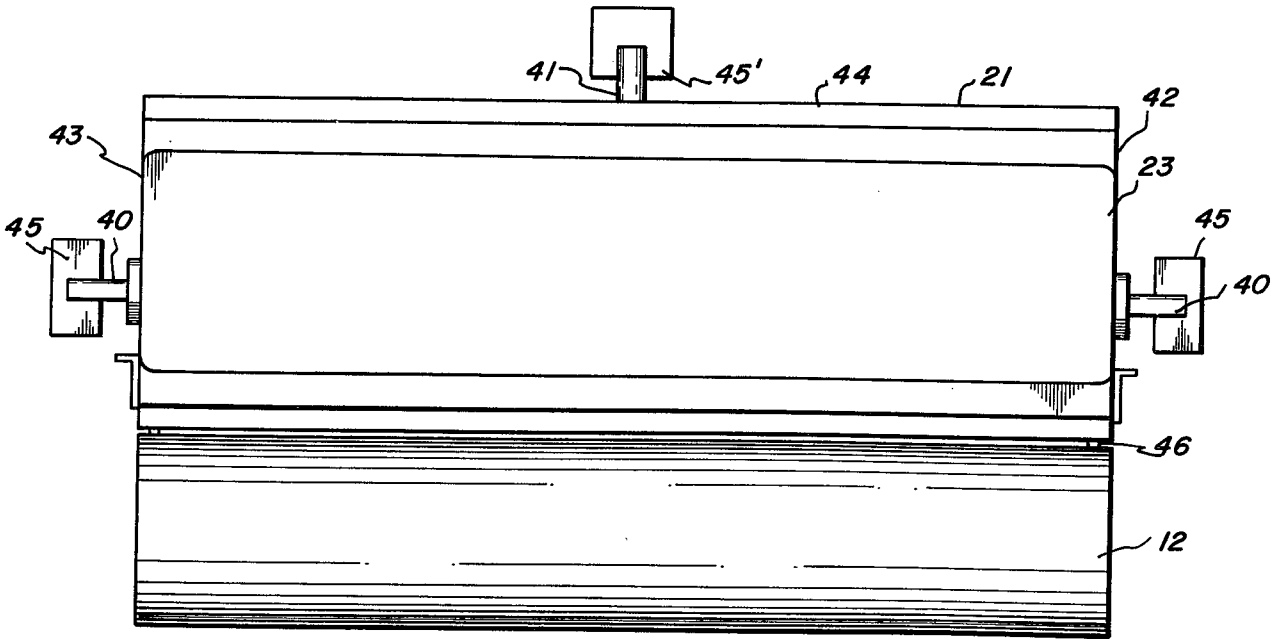
FIG. 4 is a top view of a development apparatus in accordance with this invention.

Referring now again to FIGS. 1 – 4, a preferred embodiment in accordance with the present invention will be described. As shown in FIGS. 3 and 4, the development housing 21 is supported by means of three pins 40 and 41. One pin 40 extends outwardly from each of the sides 42 and 43 of the development housing. A third pin 41 is located centrally of the housing and extends out from its rear wall 44. Each of the pins 40 and 41 ride upon stationary support members 45 and 45'. The housing 21 is, therefore, supported for movement both toward and away from the surface 13 of the imaging member 12 and can also tilt or pivot with respect to that surface, i.e., with respect to the rotational axis of the drum.

In order to space the housing 21 and, therefore, the development member or magnetic brush roll 25 from the surface 13 of the imaging member 12, shoe type follower members 46 are provided. The shoes 46 are supported by the sides 42 and 43 of the housing 21 and ride in contact with the ends of the surface 13 of the imaging member outside of the field of the image.

The shoe type follower members 46 are biased against the surface of the imaging member by means of a spring 47 and inclined plane biasing member arrangement 48, as shown. Referring to FIG. 3, a biasing member 48, having an inclined plane portion 49, is supported about a post 50. A slot and key arrangement (not shown) prevents the member 48 from pivoting about the post. A tinnerman nut or other suitable device is secured to the post below the biasing member to provide a stop surface so that the member 48 can be lifted out of contact with the housing. The post 50 extends vertically and the inclined plane 49 is inclined with respect to the vertical post. The post 50 is rotatably supported in a bracket 52 attached to the machine frame (not shown). The spring 47 is located about the post 50 and extends between the bracket 52 and the housing member 48 to provide the necessary force on the biasing member to urge the shoes 46 supported by the housing 21 against the drum.

The post 50 includes an L-shaped portion 53 which permits the operator to lift the biasing member 48 out of contact with the rear wall 44 of the housing and to turn it 90° from the position shown in order to permit removal of the housing from the machine. When turned 90° the biasing member 48 after the post is released is no longer in contact with the housing 21.

In its operative position the inclined portion 49 of the biasing member 48 urges the housing toward the drum. The biasing member is free to pivot with the post and, therefore, the housing continues to be biased against the drum even as it pivots to account for skew. Further, the housing 21 can move toward and away from the drum surface without loosing the spring bias because the inclined plane portion 49 will remain in contact with the housing.

The shoes 46 are supported on opposing sides of the housing 21 by means of a pivoting lever 60 which is pivoted about pin 61. The free end of the lever includes a tab portion 62 having a hole through which an adjustment screw 63 is passed. A bracket 64 is secured to the side 42 or 43 of the developer housing for receiving in threaded engagement the adjustment screw 63. A spring 65 is interposed about the screw between the bracket 64 and the tab 62. The screw adjustment 63 provides a means for adjusting the position of the shoe 46 relative to the development roll 25. As shown in FIG. 2, the shoes 46 are pivotally supported about pins P mounted to the lever 60.

During manufacture any tolerance stack-up in the development system can be compensated for by means of the adjustment 63 of the shoe positions on each side of the housing. This is generally done against a slave drum in a manufacturing fixture. After this adjustment has been performed the gap between the surface 13 against which the shoes 46 ride and the development roll 25 will be substantially constant across the axial length of the development roll.

It has been found desirable to electrically isolate the developer housing 21 from the machine frame so that it may be electrically biased in operation. Therefore, preferably the support members 45 and 45' as well as the biasing member 48 are formed of any desired electrically insulating material. The use of Delrin AF for the housing member 48 provides a low friction and wear resistant surface 49.

The follower members 46 in accordance with this invention have been described thus far as shoe type devices. Preferably they are formed of a material which is both wear resistant and has a low coefficient of friction such as Delrin AF, which comprises an acetal resin with 20% Teflon polytetrafluroethelene) fibers, however, any desired material could be used. If desired, instead of the use of stationary shoes, rollers or other types of followers could be employed.

The housing can be tilted in the vertical direction by means of a set screw 70 adjustment for setting the height of the support member 45'. The support member is held in sliding engagement with internally threaded member 71 and the set screw 70 provides an adjustable stop surface for the support member 45'.

It has been found in practictice for one commercially available machine that the maximum drum runout at a given position on the drum is usually less than about 0.010 inches. The maximum side-to-side runout due to runout phase variations therefore for this machine would be expected to be less than 0.020 inches. The articulated developing system of this invention is fully able to compensate for these variations.

Since the housing 21 floats against the drum the drive system must be able to cope with the housing movement. Any conventional flexible drive could be utilized for this purpose. It has been found in practice that a conventional meshed gear drive 80 has a sufficient tollerance range so that it can remain meshed in good driving engagement even with housing movements of 0.020 inches.

The development apparatus 11 shown in FIGS. 1 – 4 is adapted to move essentially in a plane, namely, a horizontal plane and, therefore, it can counter drum runout and skew in the horizontal plane. There can also be skew between the imaging member 13 and the development member 25 in a vertical sense. As a further extension of this invention, the housing may be fully articulated in the sense of being able to move toward and away from the imaging surfacae; to have a component of tilt in a first substantially horizontal plane with respect to the imaging surface; and to have a component of tilt in a second and different plane (substantially vertical) about the imaging surface thereby compensating for both horizontal and vertical skew.

Figure 5:
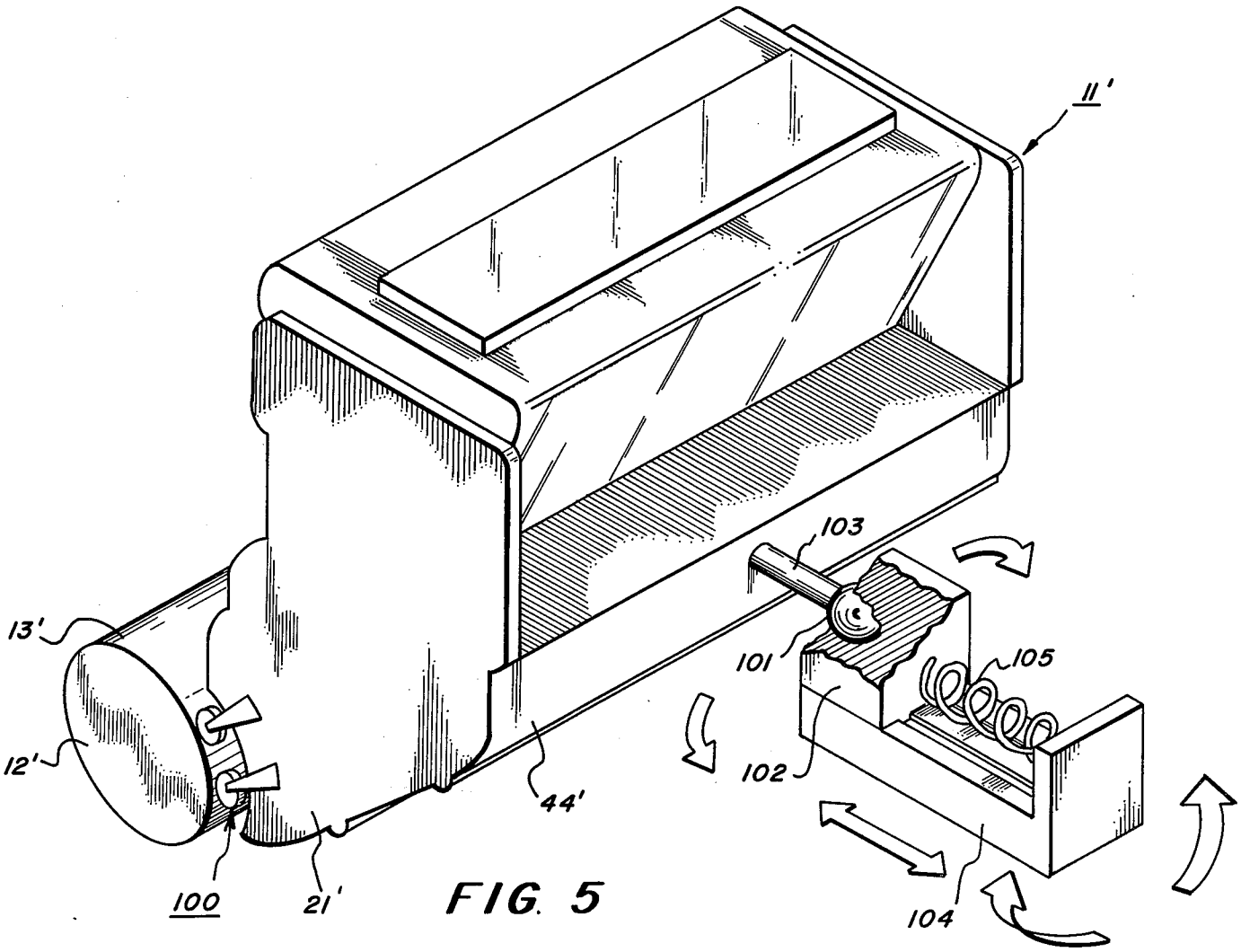
FIG. 5 is a perspective view of a development apparatus in accordance with another embodiment of this invention.

In the exemplary embodiment of FIG. 5, two sets of follower wheels 100 ride against the drum 12'. Two follower wheels are spaced circumferentially about each end of the drum surface 13' with each of the wheels 100 on each side being secured to the housing 21' in any desired manner. For example, an approach similar to that described with respect to FIGS. 1 through 4 could be employed.

The key element of this design, however, is the provision of a ball 101 and socket 102 support arrangement secured centrally of the rear wall 44' of the development apparatus 11'. The ball 101 is secured to the housing 21' by means of a shaft 103. The socket member 102 which receives the ball is supported in sliding engagement by a bracket 104 secured to the machine frame (not shown). The socket member 102 is spring biased by means of spring 105 supported between the bracket 104 and the member 102. This causes the socket to urge the housing 21' against the drum surface 13 so that the housing will track the drum surface.

This arrangement permits the housing to tilt both vertically and horizontally and allows it to move toward and away from the drum.

The patents and texts referred to specifically in this application are intended to be incorporated by reference into the application.

It is apparent that there has been provided in accordance with this invention, an articulated development and reproducing machine including the development apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a magnetic brush development apparatus for developing images on a moving imaging surface arranged for movement about an axis of rotation, said apparatus including at least one magnetic brush development member for applying developer to said surface where it moves about said axis, said member extending across said imaging surface from side-to-side of said member to define a gap therebetween extending from said imaging surface to said member, the improvement wherein, said apparatus further includes:

means for maintaining said gap substantially constant from side-to-side of said member, said maintaining means including means for compensating for runout of said imaging surface and for side-to-side phase variations in said runout, said compensating means including means for supporting said development member for movement toward and away from said imaging surface, said supporting means including means for supporting said member for side-to-side tilting movement with respect to said imaging surface.

2. An apparatus as in claim 1, wherein said development member comprises a magnetic brush development roll and further including follower means associated with said roll, said follower means engaging said moving imaging surface to space said roll from said imaging surface to define said gap.

3. An apparatus as in claim 2, wherein said roll is rotatably supported in a housing and wherein said supporting means supports said housing for said movement toward and away from said imaging surface and for said side-to-side tilting movement with respect to said imaging surface, and wherein said follower means is connected to said housing, said follower means engaging said moving imaging surface to space said housing and said roll from said imaging surface to define said gap, and means for urging said housing so that said follower means engages said imaging surface.

4. An apparatus as in claim 3, wherein said imaging surface comprises a cylindrical outer surface of a drum-like member.

5. In a development apparatus for developing images on a moving imaging surface, said apparatus including at least one development member extending across the imaging surface to define a gap therebetween, the improvement wherein, said apparatus further includes:

means for maintaining said gap substantially constant, said maintaining means including means for supporting said development member for movement toward and away from said imaging surface, said support means also including means for supporting said member for tilting movement with respect to said imaging surface, said tilting movement support means including means for supporting said development member for tilting with respect to said surface in a first plane, and means for supporting said development member for tilting with respect to said surface in a second and different plane, and ball and socket means connecting said member to a stationary support member whereby said maintaining means is adapted to compensate for runout of said imaging surface and for side-to-side phase variations in said runout and whereby said apparatus is fully articulated.

6. An apparatus as in claim 1, wherein said tilting means for side-to-side movement is arranged to provide a component of tilt in a first substantially horizontal plane with respect to said imaging surface and a component of tilt in a substantially vertical plane with respect to the imaging surface whereby said apparatus is adapted to compensate for both horizontal and vertical skew.

7. An apparatus as in claim 5, wherein said development apparatus comprises a magnetic brush development apparatus and wherein said development member comprises a magnetic brush development roll.

8. An apparatus as in claim 7, wherein said imaging surface comprises the cylindrical outer surface of a drum-like member.

9. In a reproducing apparatus including a moving imaging surface arranged for movement about an axis of rotation and means for developing images on said surface, said development means including at least one magnetic brush development member for applying developer to said surface where it moves about said axis, said member extending across said imaging surface from side-to-side of said member to define a gap therebetween extending from said imaging surface to said member, the improvement wherein, said apparatus further includes:

means for maintaining said gap substantially constant from side-to-side of said member, said maintaining means including means for compensating for runout of said imaging surface and for side-to-side phase variations in said runout, said compensating means including means for supporting said development member for movement toward and away from said imaging surface, said supporting means including means for supporting said member for side-to-side tilting movement with respect to said imaging surface.

10. An apparatus as in claim 9, wherein said apparatus comprises an electrostatographic reproducing machine further including means for forming an electrostatic image on said imaging surface, said development means being adapted to develop said electrostatic image, and means for transferring said developed image from said imaging surface to a sheet of final support material.

11. An apparatus as in claim 10, wherein said development member comprises a magnetic brush development roll and further including follower means associated with said roll, said follower means engaging said moving imaging surface to space said roll from said imaging surface to define said gap.

12. An apparatus as in claim 11, wherein said roll is rotatably supported in a housing and wherein said supporting means supports said housing for said movement toward and away from said imaging surface and for said side-to-side tilting movement with respect to said imaging surface, and wherein said follower means is connected to said housing, said follower means engaging said moving imaging surface to space said housing and said roll from said imaging surface to define said gap, and means for urging said housing so that said follower means engages said imaging surface.

13. An apparatus as in claim 12, wherein said imaging surface comprises a cylindrical outer surface of a drum-like member.

14. In a reproducing apparatus including a moving imaging surface and means for developing images on said surface, said development means including at least one development member extending across the imaging surface to define a gap therebetween, the improvement wherein, said apparatus further includes:

means for maintaining said gap substantially constant, said maintaining means including means for supporting said development member for movement toward and away from said imaging surface, said support means also including means for supporting said member for tilting movement with respect to said imaging surface, said tilting movement support means including means for supporting said development member for tilting with respect to said surface in a first plane, and means for supporting said development member for tilting with respect to said surface in a second and different plane, and ball and socket means connecting said member to a stationary support member whereby said maintaining means is adapted to compensate for runout of said imaging surface and for side-to-side phase variations in said runout and whereby said apparatus is fully articulated.

15. An apparatus as in claim 14, wherein said imaging surface comprises the cylindrical outer surface of a drum-like member.

16. An apparatus as in claim 14, wherein said tilting means for side-to-side movement is arranged to provide a component of tilt in a first substantially horizontal plane with respect to said imaging surface and a component of tilt in a substantially vertical plane with respect to the imaging surface whereby said apparatus is adapted to compensate for both horizontal and vertical skew.

17. An apparatus as in claim 14, wherein said development apparatus comprises a magnetic brush development apparatus and wherein said development member comprises a magnetic brush development roll.

* * * * *